US008453388B2

(12) United States Patent
Neuhofer, Jr.

(10) Patent No.: US 8,453,388 B2
(45) Date of Patent: Jun. 4, 2013

(54) WALL LINING

(76) Inventor: Franz Neuhofer, Jr., Zell am Moos (AT)

( * ) Notice: Subject to any disclaimer, the term of this patent is extended or adjusted under 35 U.S.C. 154(b) by 0 days.

(21) Appl. No.: 12/998,709

(22) PCT Filed: Dec. 29, 2009

(86) PCT No.: PCT/AT2009/000498
§ 371 (c)(1),
(2), (4) Date: May 20, 2011

(87) PCT Pub. No.: WO2010/078607
PCT Pub. Date: Jul. 15, 2010

(65) Prior Publication Data

US 2011/0239571 A1 Oct. 6, 2011

(30) Foreign Application Priority Data

Jan. 9, 2009 (AT) ..... 32/2009

(51) Int. Cl.
*E04B 2/74* (2006.01)

(52) U.S. Cl.
USPC ..... 52/36.5; 52/506.06; 52/509; 52/512; 52/772; 211/94.01

(58) Field of Classification Search
USPC ..... 52/36.4, 36.5, 384, 506.05, 506.06, 52/509, 512, 762, 770, 772, 506.08; 211/94.01
See application file for complete search history.

(56) References Cited

U.S. PATENT DOCUMENTS

| | | | | |
|---|---|---|---|---|
| 2,947,093 | A * | 8/1960 | Masters | 434/421 |
| 3,038,571 | A * | 6/1962 | Clements | 52/464 |
| 3,181,662 | A * | 5/1965 | Maertzig, Jr. | 52/509 |
| 6,837,384 | B2 * | 1/2005 | Secondino | 211/87.01 |

FOREIGN PATENT DOCUMENTS

| | | |
|---|---|---|
| CN | 2 890 226 | 4/2007 |
| DE | 23 48 123 | 4/1975 |
| DE | 10 2005 004 654 | 8/2006 |
| DE | 20 2006 012 093 | 11/2006 |
| EP | 1 052 751 | 11/2000 |
| GB | 2 300 351 | 11/1996 |

OTHER PUBLICATIONS

EPO machine translation of 102005004654.*
EPO machine translation of 202006012093.*
International Search Report.

* cited by examiner

*Primary Examiner* — Brian Glessner
*Assistant Examiner* — Brian D Mattei
(74) *Attorney, Agent, or Firm* — Collard & Roe, P.C.

(57) ABSTRACT

A wall lining is described, comprising wall panels (1) and holding profiles (2) which respectively comprise a downwardly open receiving groove (4) for a bottom wall panel (1), an upwardly open receiving groove (3) for an upper wall panel (1) and a suspension groove (5) for fixing hooks between the two receiving grooves (3, 4). In order to enable the insertion of wall panels (1) of different thickness it is proposed that the two receiving grooves (3, 4) of the holding profiles (2) which can be fixed to the wall, which grooves form a stop surface (9) for the outside of the wall panels (1) on the side facing away from the wall (6), form at least two sections (11) in the direction of the groove depth with different widths for holding wall panels (1) of different thickness.

3 Claims, 3 Drawing Sheets

WALL LINING

CROSS REFERENCE TO RELATED APPLICATIONS

This application is the National Stage of PCT/AT2009/000498 filed on Dec. 29, 2009, which claims priority under 35 U.S.C. §119 of Austrian Application No. A 32/2009 filed on Jan. 9, 2009, the disclosure of which is incorporated by reference. The international application under PCT article 21 (2) was not published in English.

FIELD OF THE INVENTION

The invention relates to a wall lining with wall panels and holding profiles which respectively comprise a downwardly open receiving groove for a bottom wall panel, an upwardly open receiving groove for an upper wall panel and a suspension groove for fixing hooks between the two receiving grooves.

DESCRIPTION OF THE PRIOR ART

In order to produce wall linings on which accessories such as shelves, trays, hanging rails, baskets, and the like can be fastened, it is known to provide holding profiles between the individual wall panels which engage in grooves on the face side of the longitudinal edges of the wall panels and encompass the front groove wall of these panel grooves in the receiving grooves themselves. A suspension groove for fixing hooks is obtained between the upwardly and downwardly open receiving grooves of the holding profiles, with the help of which the accessories can be optionally mounted on the wall lining. The disadvantageous aspect in these wall linings is however that the wall panels and the holding profiles need to be adjusted precisely with respect to one another and the holding profiles are used only for connecting the wall panels but not for fixing them to the wall.

SUMMARY OF THE INVENTION

The invention is thus based on the object of providing a wall lining of the kind mentioned above in such a way that differently thick wall panels, e.g. panels as are used in floors for example, can be used and simple fixing is provided for these wall panels.

This object is achieved by the invention in such a way that the two receiving grooves of the holding profiles that can be fixed to the wall, which grooves form a stop surface for the outside of the wall panels on the side facing away from the wall, form at least two sections in the direction of the groove depth with different widths for holding wall panels of different thickness.

Since as a result of these measures the holding profiles are fastened to the wall to be lined, no special precautions need to be taken any more for the fastening of the wall panels because these wall panels are tightly held within the receiving grooves of the holding profile which encompass them along the longitudinal edges. This fastening of the wall panels by way of the holding profiles also offers the simple possibility of adjusting the holding profiles to wall panels of different thickness because the receiving grooves of the holding profiles are able to form successive sections with different widths for holding wall panels of different thickness in the direction of the groove depth. Since the receiving grooves form a stop surface for the wall panels on the side facing away from the wall, this stop surface defines the outside surface of the wall lining irrespective of the thickness of the employed wall panels. The height distance of the horizontally laid wall panels can change as a result of the different insertion depths in the receiving grooves of the holding profiles which are caused by the different thickness of the wall panels, which usually is not relevant since the same wall panels are used for a wall lining.

The wall lining offers a simple kind of laying because a holding profile can be fixed to the wall at first in which a wall panel is inserted in its upwardly open receiving groove, on which a further holding profile is placed and is fastened to the wall before a further panel is laid, so that the wall lining is built panel to panel from bottom to top, with the insertion depth of the wall panels in the receiving grooves of the holding profiles being obtained automatically as a result of the thickness of the wall panels.

The receiving grooves of the holding profiles can form a groove wall on the side opposite of the stop surface for accommodating wall panels of different thickness, with the distance of the groove wall from the stop surface decreasing gradually towards the base of the groove. A separate step is thus obtained for each thickness of the panel. Especially simple constructional conditions are obtained in this connection when the cross-section of the receiving grooves tapers at least in steps towards the base of the groove, because the wedge-shaped gap obtained as a result of the tapering between the front and rear groove wall of the receiving grooves ensures play-free support of the wall panels. A continuous adjustment to differently thick wall panels is enabled by a rear groove wall which is continuously inclined over the depth of the groove.

The wall lining can be terminated with a holding profile as is used between the wall panels. It is recommended for aesthetic reasons however to provide an end profile for the uppermost wall panel of the wall lining which comprises a receiving groove which encompasses the upper longitudinal edge of the wall panel and which forms at least two sections in the direction of the groove depth with different widths for holding wall panels of different thickness. In the case of lateral holding of the uppermost wall panel in the lateral end rails of the wall lining, this end profile may merely be inserted into or glued on uppermost wall panel. If additional support of the uppermost wall panel is demanded in the region of upper longitudinal edge, the end profile can comprise a wall limb engaging in a wall mounting bracket, with the engagement depth of the wall limb in the wall mounting bracket allowing an adjustment to the respective panel thickness without having to displace the wall mounting bracket in this respect precisely according to height.

BRIEF DESCRIPTION OF THE DRAWINGS

The subject matter of the invention is shown by way of example in the drawings, wherein.

DESCRIPTION OF THE PREFERRED EMBODIMENTS

Figure 1:
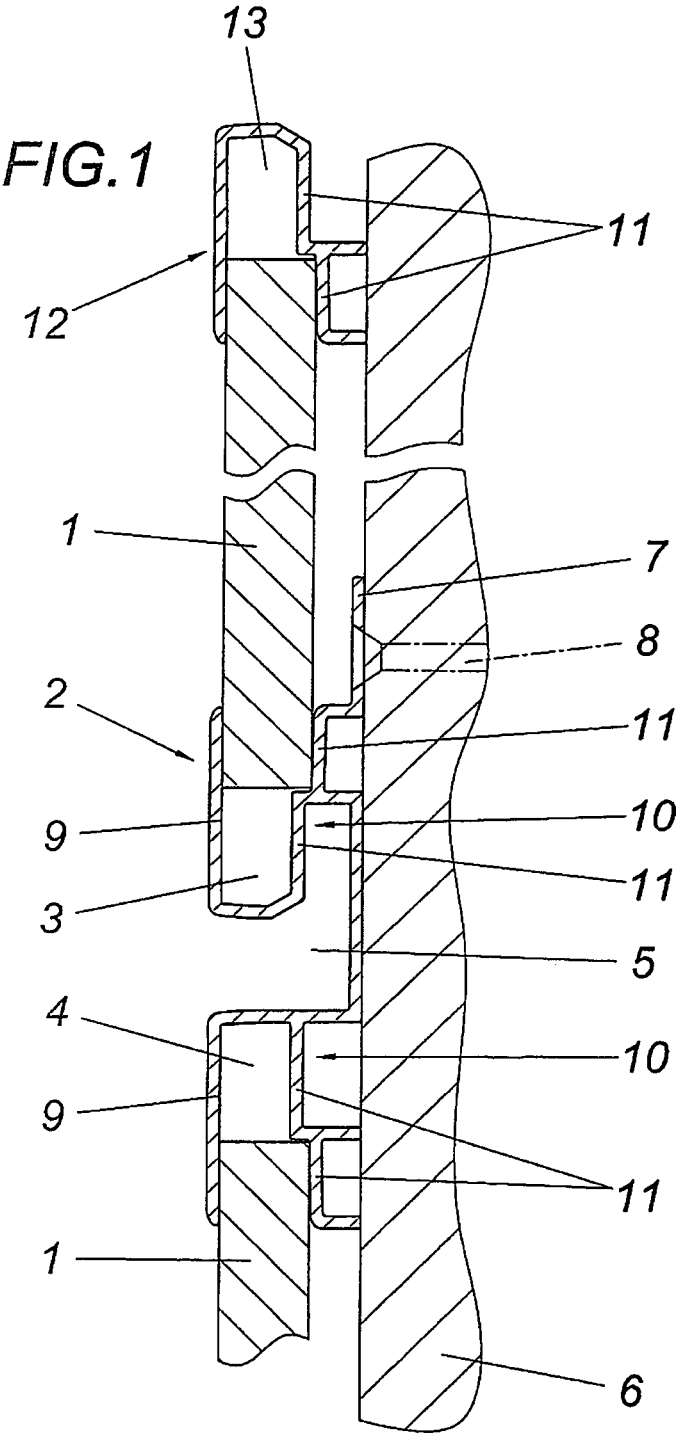
FIG. 1 shows sections of a wall lining in accordance with the invention in the region of the uppermost wall panels in a schematic cross-sectional view.

The illustrated wall lining is composed of individual wall panels 1 which are similar among each other and which are offset in parallel with respect to each other in the horizontal direction with the help of holding profiles. The holding profiles 2 respectively comprise upwardly and downwardly open receiving grooves 3, 4 for the longitudinal edges of the wall panels 1 and a suspension groove 5 between these receiving grooves 3, 4 for fixing hooks of accessories such as shelves, trays, hanging rails, baskets and the like. A fixing limb 7 which protrudes beyond the upper receiving groove 3 is provided for fastening the holding profiles 2 to a wall 6, which fixing limb can be fixed to the wall by means of screws 8 which are indicated with the dot-dash line. Simple working conditions for mounting the holding profiles 2 before the insertion of a wall panel 1 in the upper receiving groove 3 are obtained due to the protrusion of the fixing limb 7 relative to the receiving groove 3.

According to the embodiment according to FIG. 1, the two receiving grooves 3, 4 form stop surfaces 9 for the wall panels 1 which lie in a common plane parallel to the wall on the side facing away from the wall 6, whereas the opposite groove wall 10 is subdivided by a stepped portion in two sections 11 with different distance to the stop surface 9. As a result of this stepped portion, the distance of the groove wall 10 from the stop surfaces 9 decreases in steps towards the base of the groove, so that the holding profile 2 for two differently thick wall panels 1 can be inserted.

Figure 2:
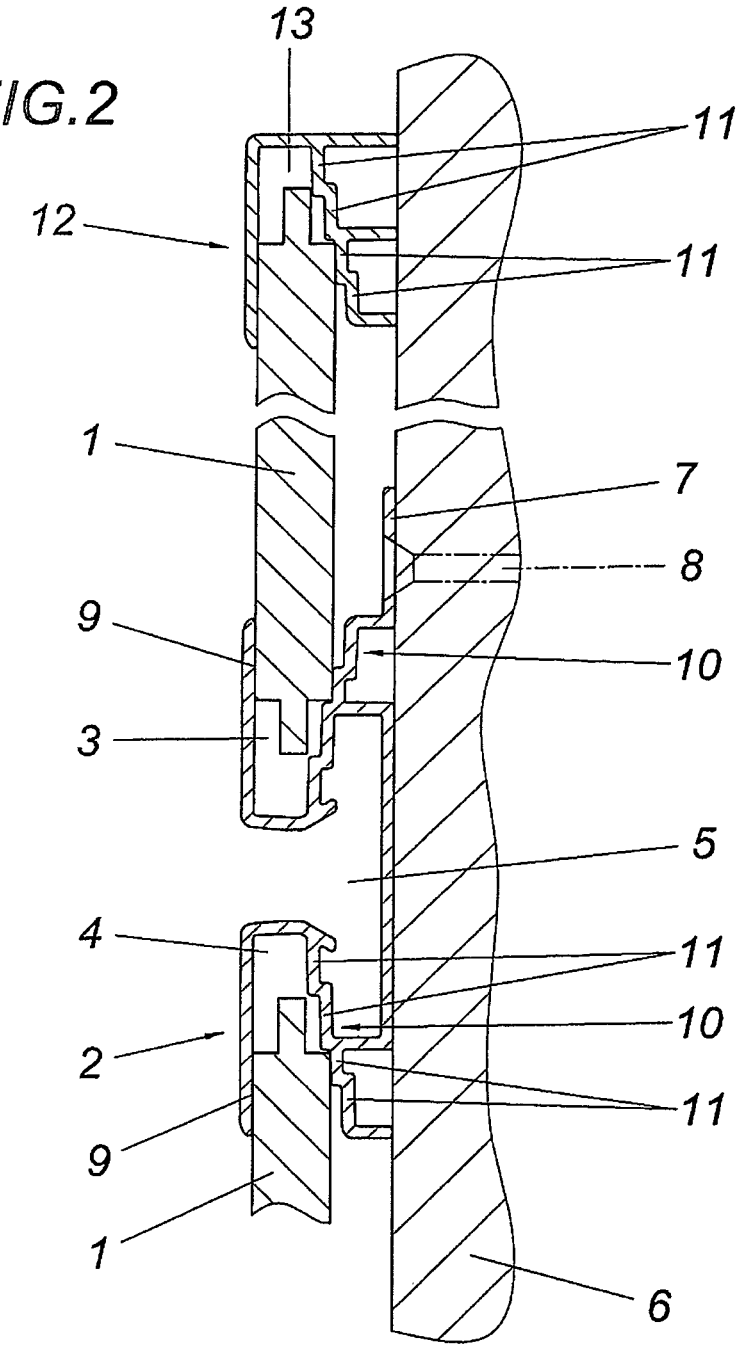
FIG. 2 shows a respective illustration of an embodiment of the wall lining in accordance with the invention as shown in FIG. 1.

Adjustments to several panel thicknesses can be achieved multiplying the stepped portions, as is indicated in FIG. 2, in which the groove wall 10 of the two receiving grooves 3, 4 forms four sections 11 each which are used for accommodating four differently thick wall panels.

Figure 3:
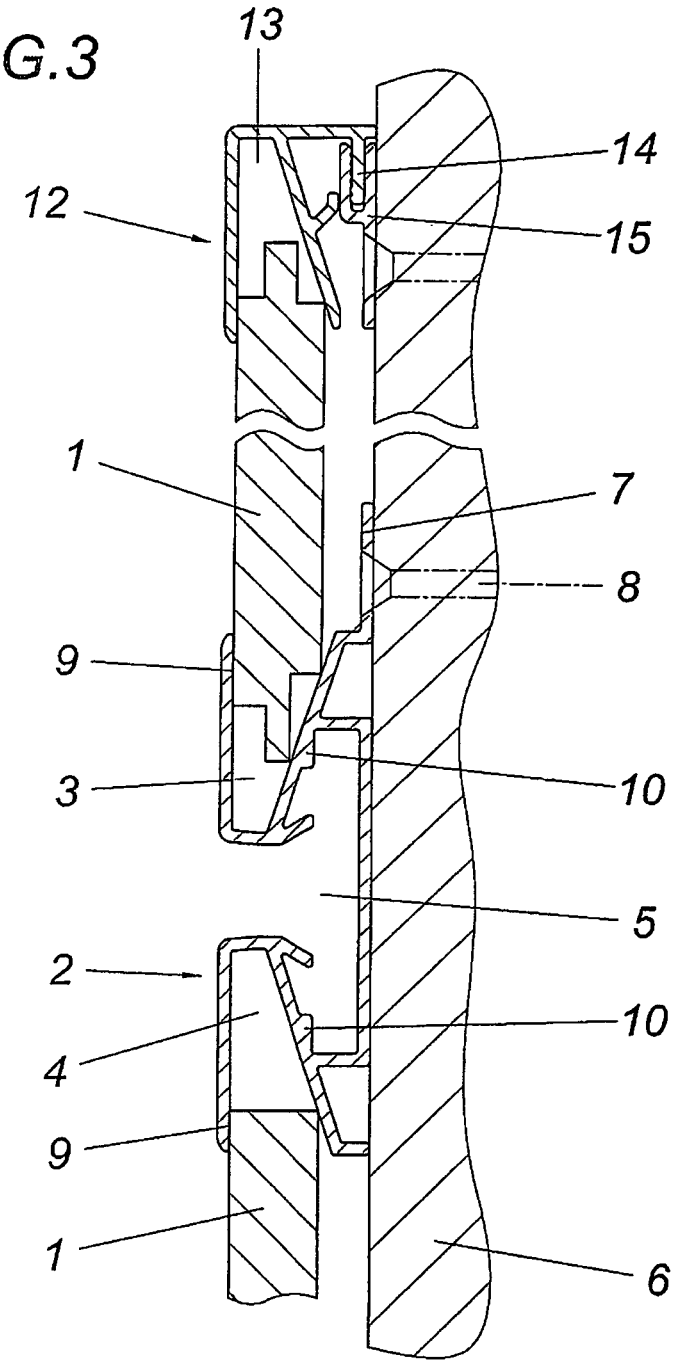
FIG. 3 shows a further constructional variant of the wall lining in accordance with the invention in a schematic cross-sectional view.

According to FIG. 3, the groove wall 10 which is opposite of the stop surface 9 is inclined towards the base of the groove within the terms of a tapering of the groove cross-section, so that a continuous adjustment to different panel thicknesses is obtained.

In order to mount a wall lining, a wall panel 1 is inserted in the upper receiving groove 3 of the last fastened holding profile 2 starting from a lowermost holding profile 2 fixed to the wall 6 before said wall panel 1 is fixed relative to the wall 6 with the help of a further holding profile 2 placed on its upper longitudinal edge, in that said holding profile 2 is anchored in wall 6 by means of its fixing flange 7. A new wall panel 1 can then be inserted in the finally mounted holding profile 2 and the mounting process can be repeated up to the uppermost wall panel 1 of the wall lining. The uppermost wall panel 1 often does not need any additional wall fastening in the region of its upper longitudinal edge when this wall panel 1 is held by means of lateral end rails of the wall lining. A respective bordering corresponding to the holding profiles 2 is recommended for visual reasons. For this purpose, an end profile 12 with a receiving groove 13 which encompasses the upper longitudinal edge of the wall panel 1 can be provided for the uppermost wall panel 1, which receiving groove, like the receiving grooves 3, 4 of the holding profile 2, can form in the direction of the groove depth at least two sections 11 of different width for receiving wall panels 1 of different thickness, so that the adjustability option also applies to the end profile 12, which is not mandatory however. In FIGS. 1 and 2, these end profiles 12 merely rest on the wall 6 without being anchored in the wall 6. If respective anchoring is required, the end profile 12 can comprise a wall limb 14 according to FIG. 3 which engages in an insertion slot of a wall mounting bracket 15 which is mounted on wall 6 and which provides tolerance compensation for the height position of the end profile 12 as a result of the different insertion depth.

It is understood that the invention is not limited to the illustrated embodiments and allows all configurations comprised by the claims. The holding profiles could be divided longitudinally for example in order to form the suspension groove between the longitudinal parts which can optionally each be fastened separately and which each form a receiving groove. This division may offer the advantage that an adjustment of the holding profile to the bottom and upper bordering of the wall lining is enabled.

Furthermore, two or more wall panels 1 could be connected with one another into a wall section which is inserted between two holding profiles 2. In order to ensure that such larger wall sections cannot be pressed through against the wall 6, it is recommended to provide spacers on the wall for these wall sections, on which the joined wall panels 1 can be supported. The same applies to thin wall panels 1 which can be deflected towards the wall 6 as a result of the load by the accessories suspended in the holding profiles 2. Additional spacers between the wall 6 and the wall panels 1 are advantageous in this case too.

The invention claimed is:

1. A wall lining with wall panels and holding profiles which respectively comprise a downwardly open receiving groove for a bottom wall panel, an upwardly open receiving groove for an upper wall panel and a suspension groove for fixing hooks between the two receiving grooves, wherein the holding profiles can be fixed to the wall, wherein the two receiving grooves of the holding profiles are formed between:

a respective front groove wall forming a stop surface for the outside of the wall panels on the side facing away from the wall, and a respective rigid rear groove wall for the inside of the wall panels on the side facing the wall, wherein the two receiving grooves form a respective wedge-shaped gap narrowing towards a respective groove base, the respective wedge-shaped gap being formed via a continuous inclination of the respective rigid rear groove wall toward the respective front groove wall, and wherein the wedge-shaped gaps are able to receive differently thick wall panels.

2. The wall lining according to claim 1, wherein an end profile is provided for the uppermost wall panel of the wall lining which comprises a receiving groove which encompasses the upper longitudinal edge of the wall panel and which forms at least two sections of different width in the direction of the groove depth for holding wall panels of different thickness.

3. The wall lining according to claim 2, wherein the end profile has a wall limb engaging in a wall mounting bracket.

* * * * *